US006768267B2

(12) United States Patent
Huh et al.

(10) Patent No.: US 6,768,267 B2
(45) Date of Patent: Jul. 27, 2004

(54) CATHODE RAY TUBE WITH EFFICIENTLY DRIVEN ELECTRON GUN

(75) Inventors: Woo-seok Huh, Seoul (KR); Min-cheol Bae, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/253,605

(22) Filed: Sep. 25, 2002

(65) Prior Publication Data

US 2003/0076043 A1 Apr. 24, 2003

(30) Foreign Application Priority Data

Oct. 18, 2001 (KR) ..... 2001-0064363

(51) Int. Cl.[7] ..... H01J 25/10

(52) U.S. Cl. ..... 315/5.41; 315/524; 315/382; 313/414

(58) Field of Search ..... 315/5.41, 5.24, 315/5.34, 5, 5.14, 368.16, 368.11, 382, 383, 386, 395, 396, 403, 399, 382.1, 384; 313/414, 412, 413, 409, 415, 441, 446, 447, 452

(56) References Cited

U.S. PATENT DOCUMENTS 5,864,203 A * 1/1999 Yamane ..... 313/414
6,472,808 B1 * 10/2002 Uchida et al. ..... 313/414
6,504,325 B1 * 1/2003 Kwon et al. ..... 315/382

FOREIGN PATENT DOCUMENTS

JP 1998000024860 8/1999

* cited by examiner

*Primary Examiner*—Tuyet T. Vo
(74) *Attorney, Agent, or Firm*—Leydig, Voit & Mayer, Ltd.

(57) ABSTRACT

A cathode ray tube (CRT) has an electron gun including a cathode for emitting electron beams, a control electrode for controlling emission of the electron beams from the cathode, and a screen electrode for accelerating the flow of the electron beams passing the control electrode are arranged in series. In the CRT, during a scanning period, a voltage applied to at least one of the control electrode and the screen electrode changes in response to a voltage of a data signal applied to the cathode. The control electrode and screen electrode each include three mutually electrically insulated sections for independently controlling each of three electron beams passing through the electrodes.

14 Claims, 10 Drawing Sheets

CATHODE RAY TUBE WITH EFFICIENTLY DRIVEN ELECTRON GUN

BACKGROUND OF THE INVENTION

1. Field of the Invention

The present invention relates to a cathode ray tube (CRT), and, more particularly, to a CRT having an electron gun in which a cathode for emitting electron beams, a control electrode for controlling emission of the electron beams from the cathode, and a screen electrode for accelerating the flow of the electron beams passing the control electrode are arranged in series.

2. Description of the Related Art

Referring to FIG. 1, a conventional CRT includes a panel 12, a funnel 13, an electron gun 11, and a deflection yoke 15. A fluorescent film 14 in which fluorescent substances for producing red (R), green (G), and blue (B) light are aligned in a dot or strip pattern is installed on the inner surface of the panel 12. The funnel 13 having a neck portion 13*a* and a cone portion 13*b* is sealed to the panel 12. The electron gun 11 is installed in the neck portion 13*a* of the funnel 13. The deflection yoke 15 is installed on and surrounding the cone portion 13*b* of the funnel 13 for deflecting the electron beams emitted from the electron gun 11.

The performance of the CRT 1 is determined according to a state of the electron beams emitted from the electron gun 11 and landing on the fluorescent film 14. To make the electron beams emitted from the electron gun 11 accurately land on the fluorescent film 14, a number of technologies improving focus characteristics and reducing aberration of electron lenses have been developed.

In particular, the shapes of the electron beams landing on the fluorescent film 14 are horizontally elongated when the electron beams emitted from the electron gun 11 are deflected by the deflection yoke 15, due to a difference between barrel and pincushion magnetic fields. To prevent the elongation, a dynamic focus electron gun is used. The dynamic focus electron gun synchronizes the electron beams emitted from the electron gun 11 with horizontal and vertical deflection periods so that the shapes of the electron beams are vertically elongated.

However, in the dynamic focus electron gun, as the size of the screen of the CRT increases, horizontal line deformation at the peripheral portion of the screen becomes severe. To solve that problem, a double focus CRT is used.

FIG. 2 shows a conventional double dynamic focus CRT. Referring to the drawing, a video signal processing portion 21 processes a composite video signal Sc and outputs a horizontal synchronizing signal, a vertical synchronizing signal, a data signal, and a horizontal/vertical blanking signal. The data signal including red (R), green (G), and blue (B) brightness signals, is amplified by a data signal amplifier 27. The amplified data signal Sd is biased by a voltage supplied by a first bias supplier 31 and applied to a cathode K of the electron gun 11.

A vertical deflecting signal generator 22 generates a vertical deflecting signal corresponding to the vertical synchronizing signal output from the video signal processor 21 and supplies the vertical deflecting signal to a vertical deflecting signal amplifier 24. A horizontal deflecting signal generator 23 generates a horizontal deflecting signal corresponding to the horizontal synchronizing signal output from the video signal processor 21 and supplies the generated horizontal deflecting signal to a horizontal deflecting signal amplifier 25. The vertical and horizontal deflecting signals amplified by the vertical and horizontal deflecting signal amplifiers 24 and 25 are respectively applied to vertical and horizontal deflecting yokes 15 on the CRT 1.

The horizontal/vertical blanking signal output from the video signal processor 21 is amplified by a blanking signal amplifier 26. A horizontal/vertical blanking signal Sb output from the blanking signal amplifier 26 is applied to the cathode K of the electron gun 11. A control signal Vc from a fifth bias supplier 37 is supplied to a control electrode C of the electron gun 11. A heater power supplier 36 supplies electric power to a heater (not shown) of the cathode K of the electron gun 11. A second bias supplier 32 applies a screen voltage Vec to a screen electrode S and a second focus electrode F2 of the electron gun 11. A third bias supplier 33 applies a static focus voltage Vfs having a positive polarity to first, third, and fifth focus electrodes F1, F3, and F5 of the electron gun 11. The static focus voltage Vfs has a positive polarity and a magnitude higher than the screen voltage Vec, which also has a positive polarity, to enhance acceleration and focus of the electron beams. A dynamic focus driver 35 applies a dynamic focus voltage Vfd, which changes periodically within a range above and below the static focus voltage Vfs, to fourth and sixth focus electrodes F4 and F6 so that the electron beams emitted from the electron gun 11 are made relatively oval. A fourth bias driver 34 applies an anode voltage Veb having the highest positive polarity to a final acceleration electrode A of the electron gun 11.

FIG. 3 shows the structure of the electron gun in the CRT of FIG. 2. In FIG. 3, the same reference numerals denote the same elements shown FIG. 2. In FIG. 3, reference characters $K_R$, $K_G$, and $K_B$ denote respective cathodes for producing electron beams that generate red, green, and blue light when the electron beams land on the fluorescent screen. Reference character $Sd_R/Sb_R$ denotes data and blanking signals for red light, reference character $Sd_G/Sb_G$ denotes data and blanking signals for green light, and reference character $Sd_B/Sb_B$ denotes data and blanking signals for blue light respectively applied to cathodes $K_R$, $K_G$, and $K_B$.

FIG. 4 shows the relationship between driving voltages in a conventional double dynamic focus method. In FIG. 4, reference character $T_{HS}$ denotes horizontal scanning period, reference character $V_{pl}$ denotes the minimum voltage of the dynamic focus voltage Vfd, and reference character $V_{ph}$ denotes the maximum voltage of the dynamic focus voltage Vfd.

FIG. 5A shows electron lenses formed in the electron gun of FIG. 3 during the period t1–t3, when the static focus voltage Vfs is higher than the dynamic focus voltage Vfd. FIG. 5B shows electron lenses formed in the electron gun of FIG. 3 during the periods 0–t1 and t3–t4, when the static focus voltage Vfs is lower than the dynamic focus voltage Vfd. In FIGS. 5A and 5B, reference character $A_V$ denotes the vertical direction in the electron gun, reference character $A_H$ denotes the horizontal direction in the electron gun, reference character $P_B$ denotes direction of movement of the electron beams, reference character $F_V$ denotes the vector force in the vertical direction $A_V$ applied to the electron beams, and $F_H$ denotes the vector force in the horizontal direction $A_H$ applied to the electron beams.

Referring to FIGS. 3, 4, 5A, and 5B, electron beams are generated according to the data signals $S_{dR}$, $S_{dG}$, and $S_{dB}$ corresponding to the respective cathodes $K_R$, $K_G$, and $K_B$. The electron beams are emitted in response to the control voltage Vc applied to the control electrode C. The electron beams emitted through openings of the control electrode C are accelerated by the screen voltage Vec applied to the screen electrode S.

The static focus voltage Vfs applied to the first focus electrode F1 is higher than the screen voltage Vec applied to the screen electrode S. The shapes of an outlet of the screen electrode S and an inlet of the first focus F1 are circular, but the outlet of the screen electrode S is smaller than the inlet of the first focus F1. Thus, a focus lens is formed between the screen electrode S and the first focus electrode F1. The shapes of the inlets of the first focus electrode F1 to which the static focus voltage Vfs is applied, the inlets and outlets of the second focus electrode F2 to which the screen voltage Vec is applied, and the inlets of the third focus electrode F3 to which the static focus voltage Vfs is applied are all circular. Therefore, a focus lens SL is formed as a pre-focus lens ($S_L$ of FIG. 5A or 5B) among the first, second, and third focus electrodes F1, F2, and F3. The electron beams emitted from the third focus electrode F3 are focused by the focus lens $S_L$.

The shapes of the outlets of the third focus electrode F3 are horizontally elongated while the shapes of the inlets of the fourth focus electrode F4 are vertically elongated. The shapes of the outlets of the fifth focus electrode F5 are vertically elongated while the shapes of the inlets of the sixth focus electrode F6 are circular. The static focus voltage Vfs is applied to the third and fifth focus electrodes F3 and F5 while the dynamic focus voltage Vfd is applied to the fourth and sixth focus electrodes F4 and F6. The anode voltage Veb is applied to the final acceleration electrode A.

In the periods 0–t1 and t3–t4 in which the static focus voltage Vfs is lower than the dynamic focus voltage Vfd, a first dynamic quadrupole lens, acting as a focusing lens ($Q_{L1V}$ of FIG. 5B) in the vertical direction and as a diverging lens ($Q_{L1H}$ of FIG. 5B) in the horizontal direction, is formed between the third and fourth focus electrodes F3 and F4. A second dynamic quadrupole lens, acting as a diverging lens ($Q_{L2V}$ of FIG. 5B) in the vertical direction and a focusing lens ($Q_{L2H}$ of FIG. 5B) in the horizontal direction, is formed between the fifth and sixth focus electrodes F5 and F6. After passing through the second dynamic quadrupole lens, the electron beams pass through a main lens $M_L$ between the sixth focus electrode F6 and the final acceleration electrode A. Then, electron beams having ovalshapes corresponding to the vertical and horizontal deflecting voltages are output from the main lens $M_L$.

In the period t1–t3 in which the static focus voltage Vfs is higher than the dynamic focus voltage Vfd, a first dynamic quadrupole lens acting as a diverging lens ($Q_{L1V}$ of FIG. 5A) in the vertical direction and as a focusing lens ($Q_{L1H}$ of FIG. 5A) in the horizontal direction is formed between the third and fourth focus electrodes F3 and F4. Also, a second dynamic quadrupole lens acting as a focusing lens ($Q_{L2V}$ of FIG. 5A) in the vertical direction and a diverging lens ($Q_{L2H}$ of FIG. 5A) in the horizontal direction is formed between the fifth and sixth focus electrodes F5 and F6. After passing through the second dynamic quadrupole lens, the electron beams pass through a main lens $M_L$ between the sixth focus electrode F6 and the final acceleration electrode A. Therefore, electron beams have oval shapes corresponding to the vertical and horizontal deflecting voltages are output from the main lens $M_L$.

In the electron gun for a CRT operating as described, if the CRT has a large screen, the deflecting frequency needs to be increased. Also, to increase the maximum brightness of the CRT, the range of the voltage change of the data signal applied to the electron gun should be increased. However, as the range of a voltage change of the data signal applied to the electron gun increases, the quality of the image deteriorates due to distortion of the data signal.

Accordingly, a method of efficiently driving an electron gun producing increased current density electron beams without increasing the range of a voltage change of the data signal applied to the electron gun is needed.

Referring to Japanese Unexamined Patent Application Publication No. 11-224,618, an additional modulation electrode is provided between a second grid electrode (a screen electrode) and a third grid electrode (a focus electrode). Since a voltage having a negative polarity is applied to the modulation electrode, electron beams having a low current density are cut off and electron beams having a high density current can pass through the modulation electrode. That is, the cathode current can be increased.

However, in the conventional CRT, a leakage current flows through the second grid electrode (the screen electrode) to which a voltage having a positive polarity is applied and between the first grid (the control electrode) and the modulation electrode, so that the life span of the electron gun is reduced.

SUMMARY OF THE INVENTION

To solve the above-described problems, it is an object of the present invention to provide a CRT which can efficiently increase cathode current density without increasing the range over which the voltage of a data signal applied to the electron gun changes.

To achieve the above object, there is provided a CRT having an electron gun including, arranged in series, a cathode for an emitting electron beam, a control electrode for controlling emission of the electron beam from the cathode, and a screen electrode for accelerating the electron beam passing through the control electrode, wherein, during a scanning period, a voltage applied to at least one of the control electrode and the screen electrode changes in response to voltage of a data signal applied to the cathode.

In this CRT, the cathode includes a cathode for emitting an electron beam for producing red light, a cathode for emitting an electron beam for producing green light, and a cathode for emitting an electron beam for producing blue light, and the control electrode is divided into a control electrode for red light, a control electrode for green light, and a control electrode for blue light, the control electrodes for red light, for green light, and for blue light being mutually electrically insulated from each other. Further, a voltage is applied to the control electrode for red light during the scanning period changes in response to voltage of a data signal applied to the cathode for producing red light, a voltage is applied to the control electrode for green light during the scanning period changes in response to voltage of a data signal applied to the cathode for producing green light, and a voltage is applied to the control electrode for blue light during the scanning period changes in response to voltage of a data signal applied to the cathode for producing blue light.

Yet another CRT according to the invention includes a cathode for emitting electron beams, a control electrode for controlling emission of the electron beams from the cathode, and a screen electrode for accelerating the electron beams passing through the control electrode arranged in series, wherein, the cathode includes a cathode for emitting an electron beam for producing red light, a cathode for emitting an electron beam for producing green light, and a cathode for emitting an electron beam for producing blue light, and the control electrode is divided into a control electrode for red light, a control electrode for green light, and a control electrode for blue light, the control electrodes for red light, for green light, and for blue light being mutually electrically insulated from each other. In this CRT, the control electrode for red light includes a first beam passing aperture for passing both of the electron beams from the cathodes for producing green light and blue light and a second beam passing aperture for passing the electron beam from the cathode for producing red light and the first beam passing aperture is larger than the second beam passing aperture, the control electrode for green light includes a first beam passing aperture for passing both of the electron beams from the cathodes for producing red light and blue light and a second beam passing aperture for passing the electron beam from the cathode for producing green light and the first beam passing aperture is larger than the second beam passing aperture, and the control electrode for blue light includes a first beam passing aperture for passing both of the electron beams from the cathodes for producing red light and green light and a second beam passing aperture for passing the electron beam from the cathode for producing blue light and the first beam passing aperture is larger than the second beam passing aperture.

A still further CRT according to the invention includes a cathode for emitting electron beams, a screen electrode for screening emission of the electron beams from the cathode, and a screen electrode for accelerating the electron beams passing through the screen electrode arranged in series, wherein, the cathode includes a cathode for emitting an electron beam for producing red light, a cathode for emitting an electron beam for producing green light, and a cathode for emitting an electron beam for producing blue light, and the screen electrode is divided into a screen electrode for red light, a screen electrode for green light, and a screen electrode for blue light, the screen electrodes for red light, for green light, and for blue light being mutually electrically insulated from each other. In this CRT, the screen electrode for red light includes a first beam passing aperture for passing both of the electron beams from the cathodes for producing green light and blue light and a second beam passing aperture for passing the electron beam from the cathode for producing red light and the first beam passing aperture is larger than the second beam passing aperture, the screen electrode for green light includes a first beam passing aperture for passing both of the electron beams from the cathodes for producing red light and blue light and a second beam passing aperture for passing the electron beam from the cathode for producing green light and the first beam passing aperture is larger than the second beam passing aperture, and the screen electrode for blue light includes a first beam passing aperture for passing both of the electron beams from the cathodes for producing red light and green light and a second beam passing aperture for passing the electron beam from the cathode for producing blue light and the first beam passing aperture is larger than the second beam passing aperture.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
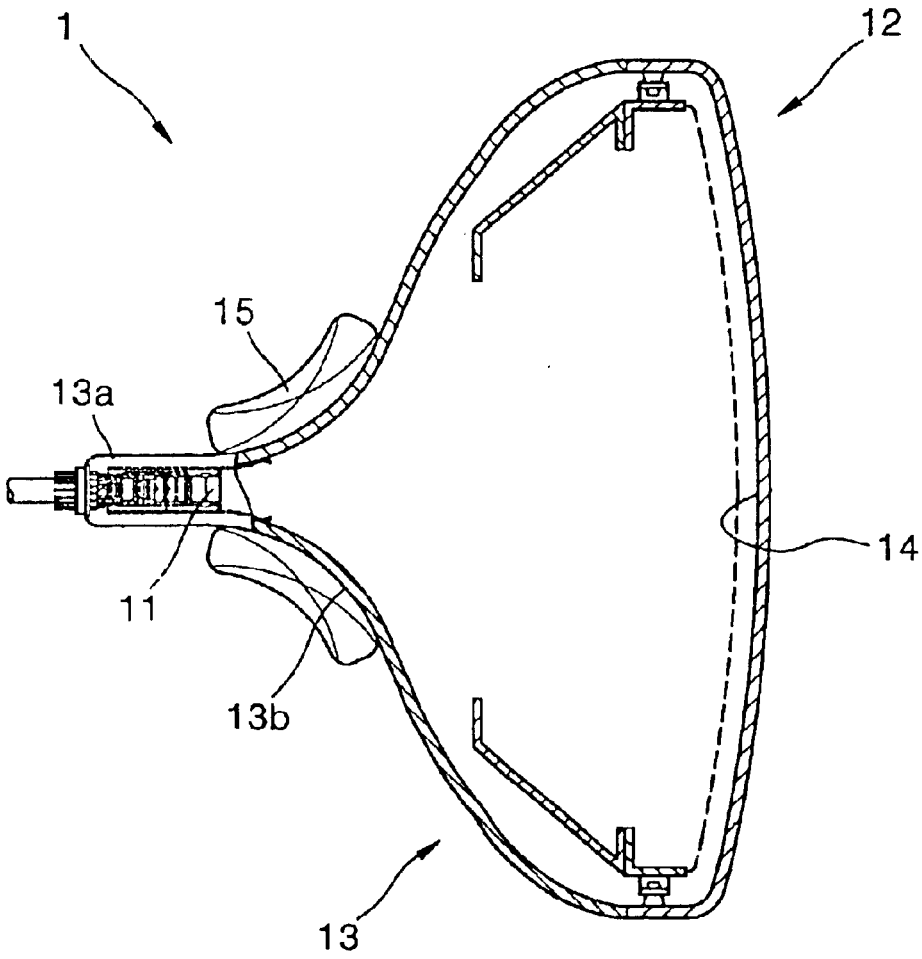
FIG. 1 (PRIOR ART)
FIG. 1 is a sectional view showing the structure of a conventional light CRT.
Figure 2:
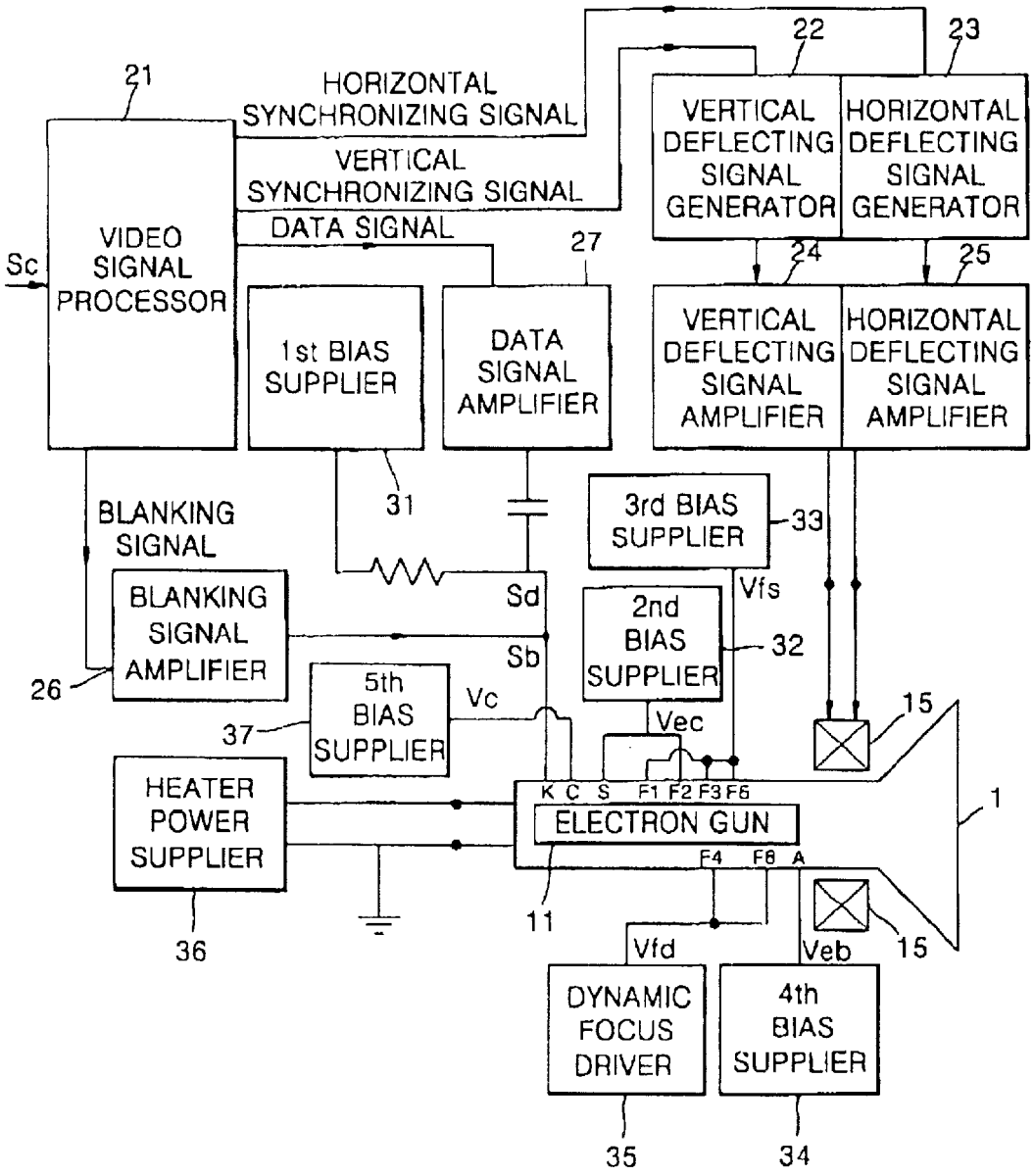
FIG. 2 (PRIOR ART)
FIG. 2 is a block diagram illustrating the driving of a conventional dynamic focus CRT.
Figure 3:
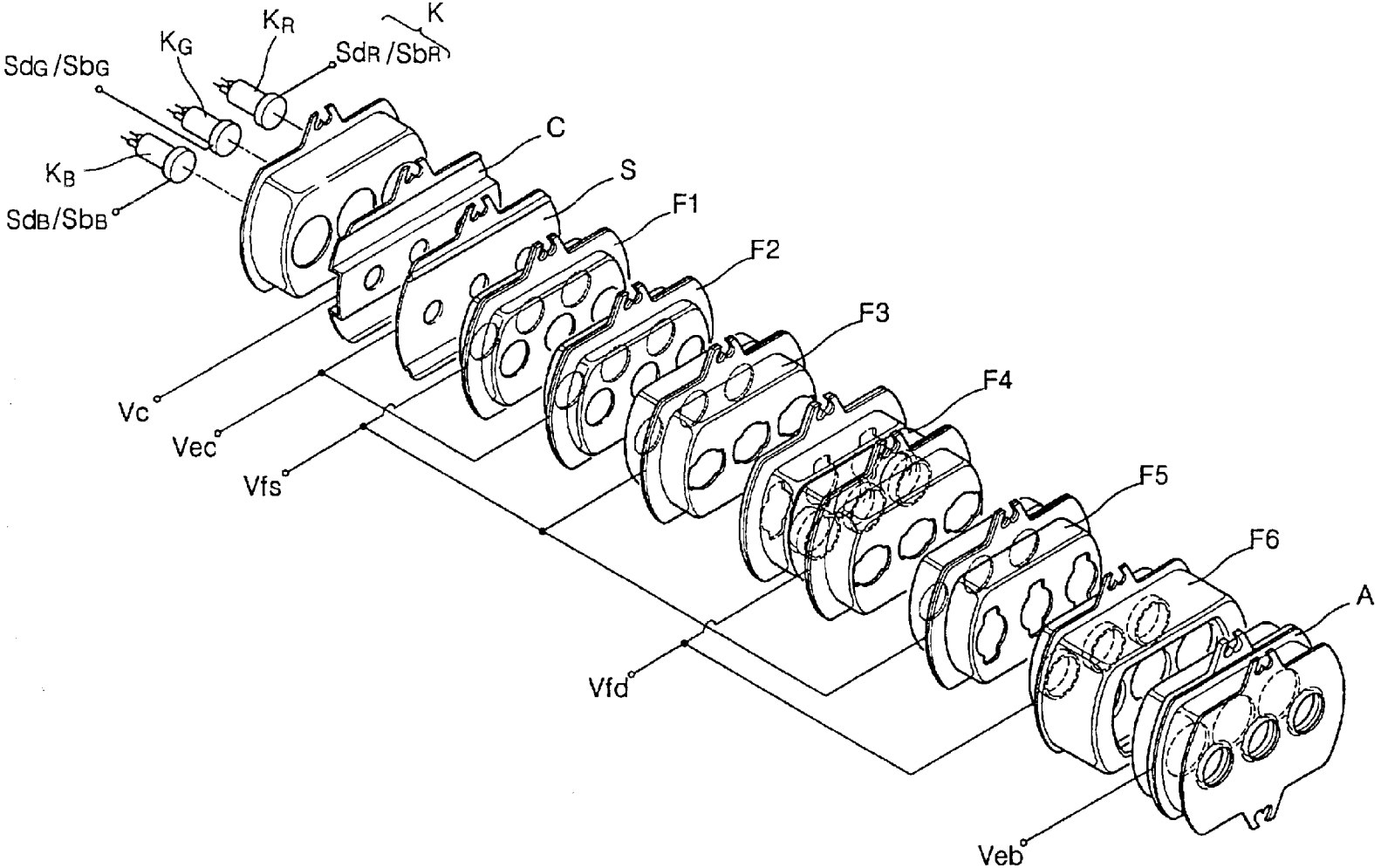
FIG. 3 (PRIOR ART)
FIG. 3 is a perspective view showing the internal structure of the electron gun of the conventional CRT driven as illustrated in FIG. 2.
Figure 4:
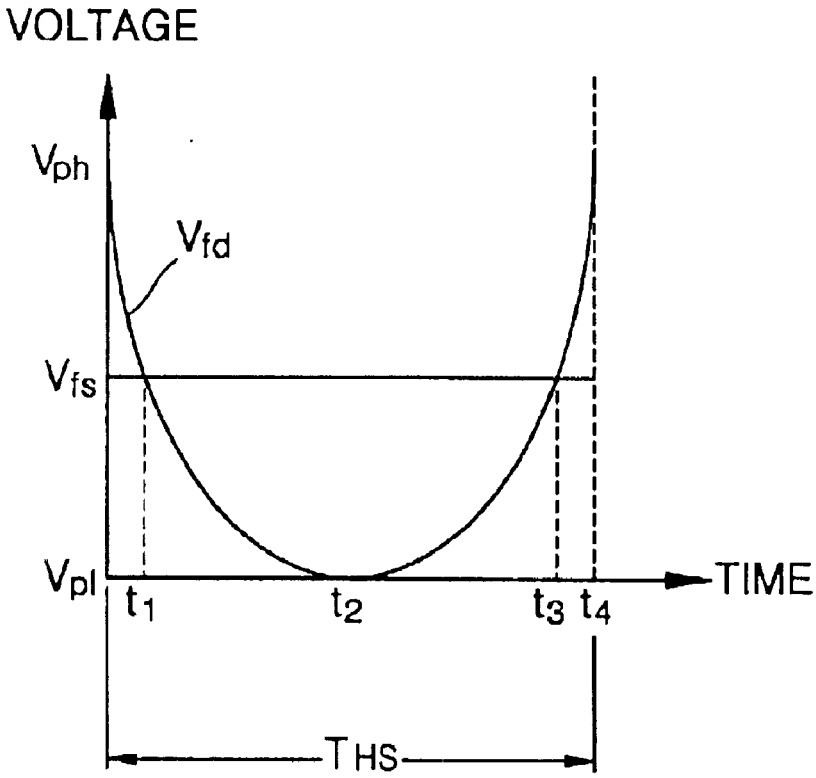
FIG. 4 (PRIOR ART)
FIG. 4 is a graph showing the driving voltage of the conventional dynamic focus CRT as a function of time for one horizontal scan.
Figure 5A:
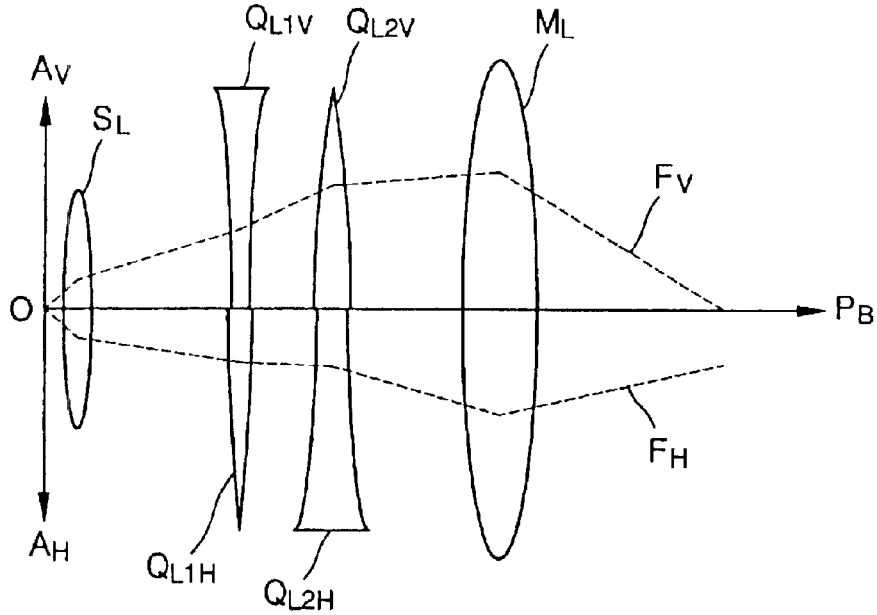
FIG. 5A (PRIOR ART)
FIG. 5A is a view showing the electron lenses formed when the static focus voltage is higher than the dynamic focus voltage in the electron gun of FIG. 3.
Figure 5B:
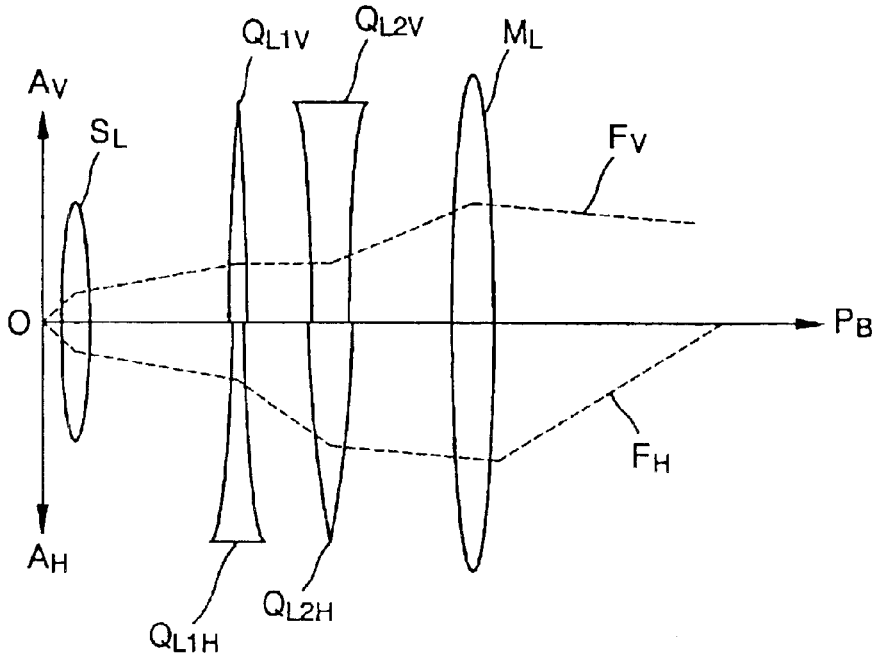
FIG. 5B (PRIOR ART)
FIG. 5B is a view showing the electron lenses formed when the static focus voltage is lower than the dynamic focus voltage in the electron gun of FIG. 3.
Figure 6:
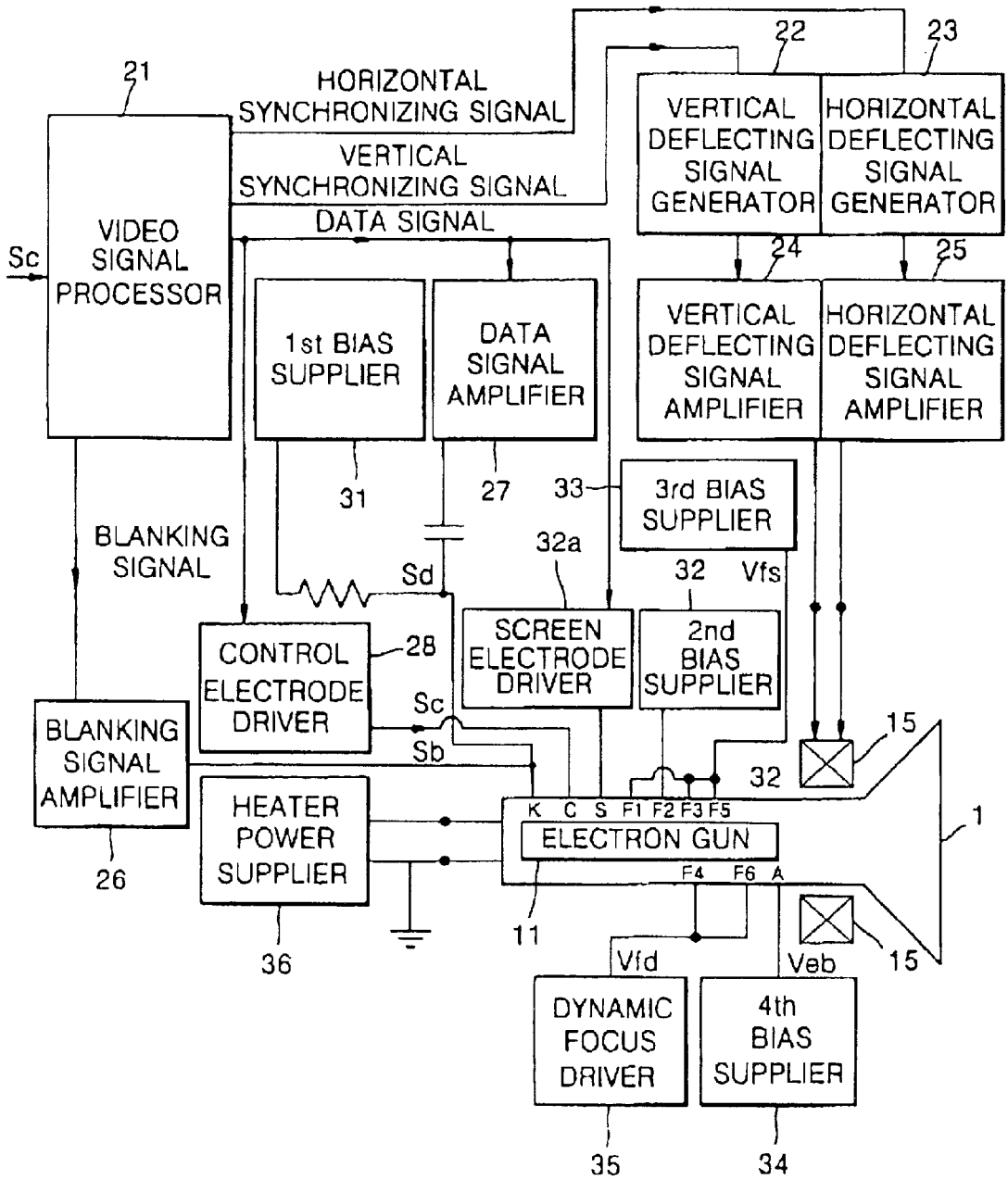
FIG. 6 is a block diagram illustrating the driving of a double dynamic focus CRT according to the present invention.

FIG. 6 shows the structure of a double dynamic focus CRT according to the present invention. Referring to FIG. 6, the video signal processor 21 processes a composite video signal Sc input from outside and outputs a horizontal synchronizing signal, a vertical synchronizing signal, a data signal, and a horizontal/vertical blanking signal.

The data signal including red (R), green (G), and blue (B) brightness signals is amplified by the data signal amplifier 27. The amplified data signal Sd is biased by a voltage supplied by the first bias supplier 31 and applied to the cathode K of the electron gun 11.

The vertical deflecting signal generator 22 generates a vertical deflecting signal corresponding to the vertical synchronizing signal output from the video signal processor 21 and supplies the vertical deflecting signal generated to the vertical deflecting signal amplifier 24. The horizontal deflecting signal generator 23 generates a horizontal deflecting signal corresponding to the horizontal synchronizing signal output from the video signal processor 21 and supplies the horizontal deflecting signal generated to the horizontal deflecting signal amplifier 25. The vertical and horizontal deflecting signals amplified by the vertical and horizontal deflecting signal amplifiers 24 and 25 are respectively applied to the vertical and horizontal deflecting yokes 15 of the CRT 1.

The horizontal/vertical blanking signal output from the video signal processor 21 is amplified by a blanking signal amplifier 26. The horizontal/vertical blanking signal Sb output from the blanking signal amplifier 26 is applied to the cathode K of the electron gun 11.

A control electrode driver 28 operated in response to the data signal output from the video signal processor 21 generates a control signal Sc. The control signal Sc is applied to the control electrode C. The voltage applied to the control electrode C during the scanning period changes in response to a voltage of the data signal Sd applied to the cathode K. Accordingly, the voltage applied to the control electrode C increases only when electron beams are emitted from the cathode K in response to the data signal Sd, so that electron beams having high current density can be emitted.

A screen electrode driver 32*a* operated by the data signal output from the video signal processor 21 generates a driving signal of the screen electrode S. The voltage applied to the screen electrode S changes in response to the voltage of the data signal Sd applied to the cathode K. Accordingly, the voltage applied to the screen electrode S increases only when the electron beams are emitted from the cathode K in response to the data signal Sd, so that electron beams having current high density can be emitted.

The heater power supplier 36 supplies electric power to a heater (not shown) of the cathode K of the electron gun 11. The second bias supplier 32 applies a constant voltage having a positive polarity to the second focus electrode F2 of the electron gun 11. The third bias supplier 33 applies a static focus voltage Vfs having a positive polarity to first, third, and fifth focus electrodes F1, F3, and F5 of the electron gun 11. The static focus voltage Vfs having a positive polarity has a magnitude higher than the screen voltage Vec, which also has a positive polarity, to enhance acceleration and focus of the electron beams. The dynamic focus driver 35 applies a dynamic focus voltage Vfd, which changes periodically within a range above and below the static focus voltage Vfs, to fourth and sixth focus electrodes F4 and F6 so that the electron beams emitted from the electron gun 11 are relatively oval. The fourth bias driver 34 applies an anode voltage Veb having the highest magnitude of the applied voltages and a positive polarity to the final acceleration electrode A of the electron gun 11.

Figure 7:
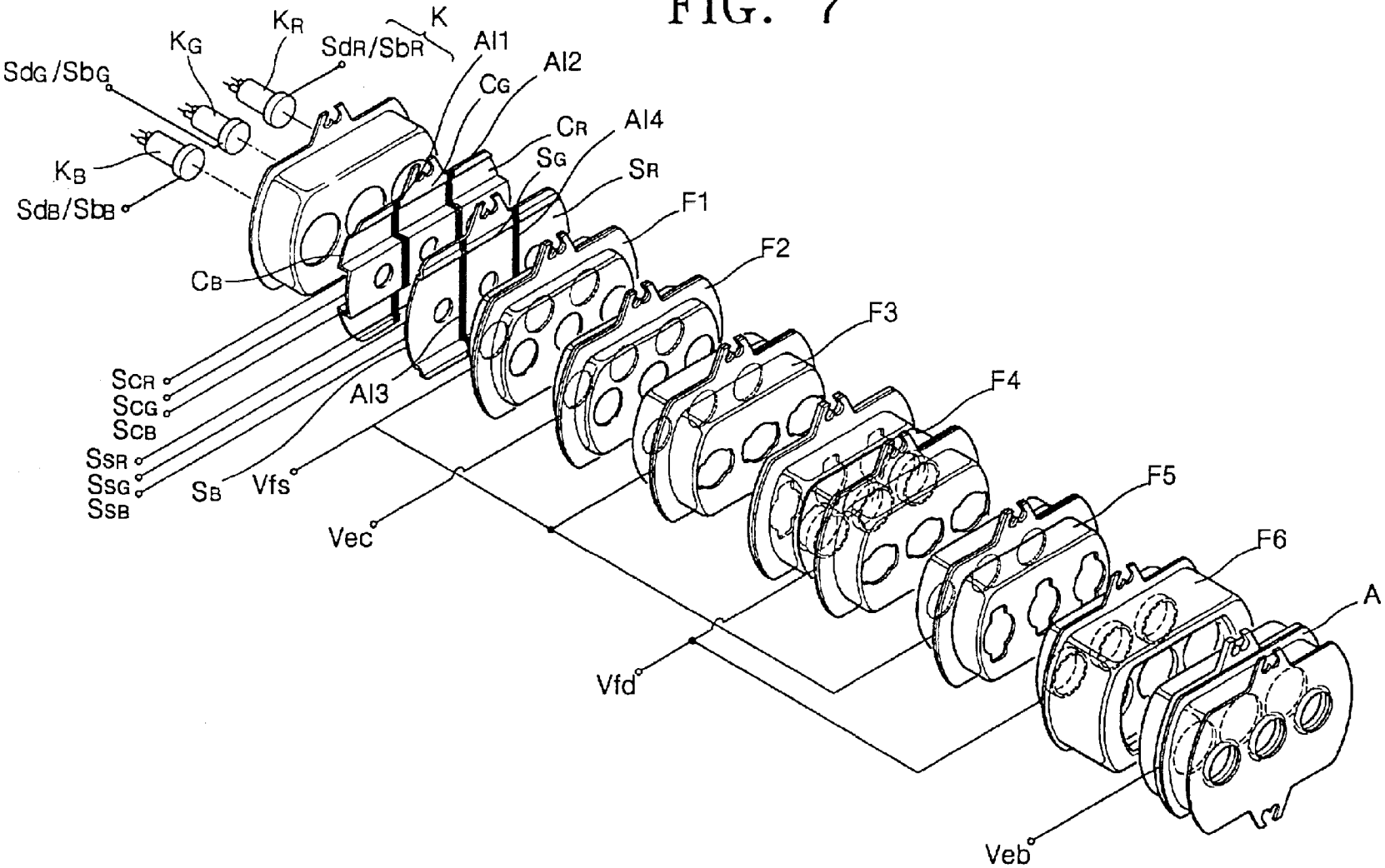
FIG. 7 is a perspective view showing the internal structure of the electron gun of the CRT driven as illustrated in FIG. 6.

FIG. 7 shows the internal structure of the electron gun for a CRT of FIG. 6. In FIG. 7, the same reference numerals as those in FIG. 6 indicate the same elements having the same functions. In FIG. 7, reference characters $K_R$, $K_g$, and $K_B$ denote cathodes for producing respective electron beams that produce red1 green, and blue light when the respective electron beams land on the fluorescent screen of the CRT. Reference character $Sd_R/Sb_R$ denotes a data signal for producing red light and a horizontal/vertical blanking signal, reference character $Sd_G/Sb_G$ denotes a data signal for producing green light and a horizontal/vertical blanking signal, and reference character $Sd_B/Sb_B$ denotes a data signal for producing blue light and a horizontal/vertical blanking signal respectively applied to the cathodes $K_R$, $K_G$, and $K_B$.

The control electrode C is divided by insulating portions AI1 and AI2 into a control electrode $C_R$ for red light, a control electrode $C_G$ for green light, and a control electrode $C_B$ for blue light. Accordingly, a control signal $Sc_R$ for red light, a control signal $Sc_G$ for green light, and a control signal $Sc_B$ for blue light are respectively applied to a control electrode $C_R$, for red light, a control electrode $C_G$, for green light, and a control electrode $C_B$, for blue light.

Likewise, the screen electrode S is divided by insulating portions AI3 and AI4 into a screen electrode $S_R$ for red light, a screen electrode $S_G$ for green light, and a screen electrode $S_B$ for blue light. Accordingly, a screen signal $Ss_R$ for red light, a screen signal $Ss_G$ for green light, and a screen signal $Ss_B$ for blue light are respectively applied to a screen electrode $S_R$ for red light, a screen electrode $S_G$ for green light, and a screen electrode $S_B$ for blue light.

Figure 8A:
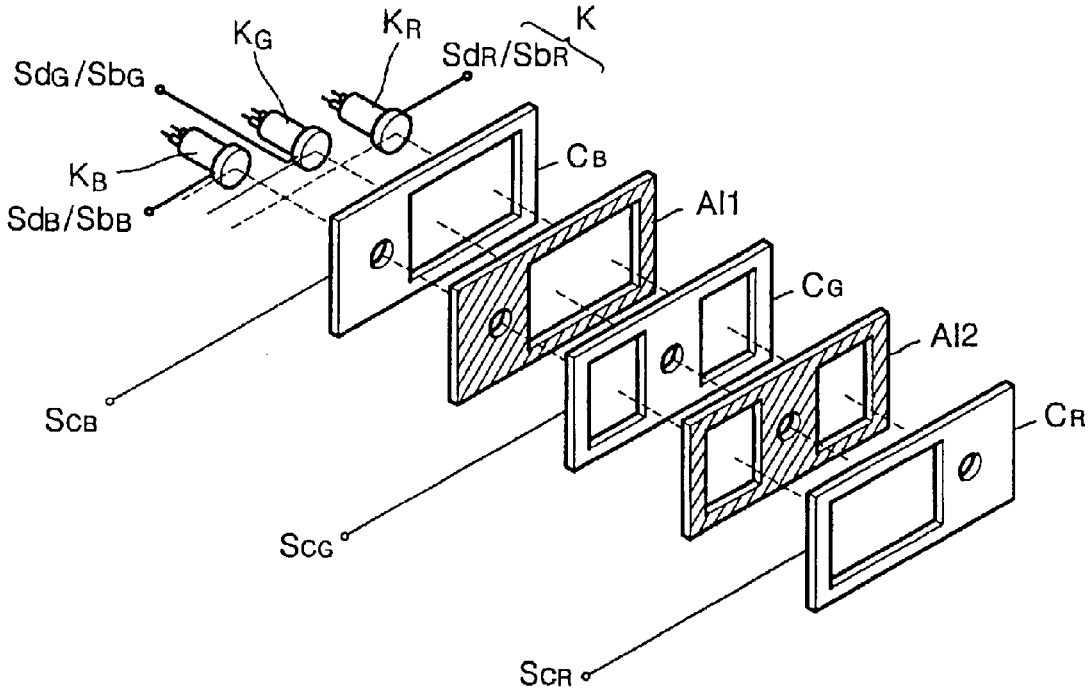
FIG. 8A is a perspective view showing the structure of cathodes and control electrodes of the electron gun of FIG. 7.
Figure 8B:
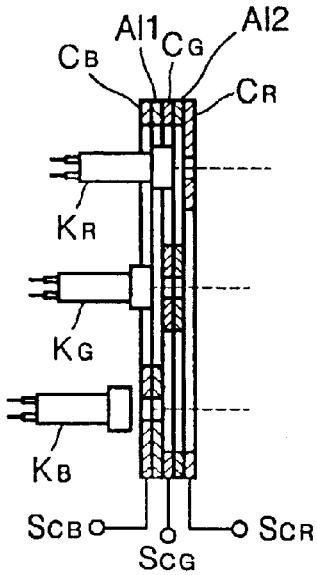
FIG. 8B is a sectional view showing the assembled cathodes and control electrodes of FIG. 8A.

FIG. 8A shows the detailed structure of the cathodes $K_R$, $K_G$, and $K_B$ and the control electrodes $C_R$, $C_G$, and $C_B$ of the electron gun of FIG. 7. FIG. 8B shows the assembled cathodes $K_R$, $K_G$, and $K_B$ and the control electrodes $C_R$, $C_G$, and $C_B$ of FIG. 8A. In FIGS. 8A and 8B, the same reference characters as those in FIG. 7 indicate the same elements having the same functions.

Referring to FIGS. 8A and 8B, in the control electrode $C_{B\ for}$ blue light, a large beam passing area is provided for passing both of the electron beams for producing green and red light. However, only a relatively small beam passing hole is provided for the electron beam for producing blue light. Thus, the electron beam for producing blue light is affected by the control signal $S_{CB}$ for blue light applied to the control electrode $C_B$ for blue light while the electron beams for producing green and red light are not influenced by the control signal $Sc_B$. Also, in the control electrode $C_G$ *for* green light, a large beam passing hole is provided for passing both of the electron beams for producing blue and red light. However, only a relatively small beam passing hole is provided for the electron beam for producing green light. Thus, the electron beam for green light is affected by the control signal $Sc_G$ for green light applied to the control electrode $C_G$ for green light while the electron beams for producing blue and red light are not influenced by the control signal $Sc_G$. Likewise, in the control electrode $C_R$ for red light, a large beam passing hole is provided for passing both of the electron beams for producing green and blue light. However, only a relatively small beam passing hole is provided for the electron beam for producing red light. Thus, the electron beam for producing red light is affected by the control signal $Sc_R$ for red light applied to the control electrode $C_R$ for red light while the electron beams for producing green and blue light are not influenced by the control signal $Sc_R$. The positions of the respective cathodes $K_R$, $K_G$, and $K_B$ are adjusted such that the distance between the cathode $K_R$ for producing an electron beam for producing red light and the control electrode $C_R$ for red light, the distance between the cathode $K_G$ for producing an electron beam for producing green light and the control electrode CG for green light, and the distance between the cathode $K_B$ for producing an electron beam for blue light and the control electrode $C_B$ for blue light are constant. Accordingly, uniform operating conditions are obtained. The same structure of the control electrodes of FIGS. 8A and 8B can be used for the screen electrodes $S_R$, $S_G$, and $S_B$ of FIG. 7.

Referring to FIGS. 4, 5A, 5B, and 7 through 8B, the electron beams are generated according to the data signals $Sd_R$, $Sd_G$, and $Sd_B$ corresponding to the respective cathodes $K_R$, $K_G$, and $K_B$. The voltage of the control signal $Sc_R$ applied to the control electrode $C_R$ for red light changes in response to the voltage of the data signal $Sd_R$ for red light. The voltage of the control signal $Sc_G$ applied to the control electrode $C_G$ for green light changes in response to the voltage of the data signal $Sd_G$ for green light. Likewise, the voltage of the control signal $Sc_B$ applied to the control electrode $C_B$ for blue light changes in response to the voltage of the data signal $Sd_B$ for blue light. Accordingly, since the voltage applied to the control electrodes $C_R$, $C_G$, and $C_B$ increase only when the electron beams are emitted from the respective cathodes $K_R$, $K_G$, and $K_B$ in response to the respective data signals $Sd_R$, $Sd_G$, and $Sd_B$, electron beams having high current density can be emitted.

The electron beams emitted through apertures of the respective electrodes $C_R$, $C_G$, and $C_B$ during the period of scanning are accelerated by the screen signals $Ss_R$, $Ss_G$, and $Ss_B$ applied to the respective screen electrodes $S_R$, $S_G$, and $S_B$. The voltage of the screen signal $Ss_R$ applied to the screen electrode $S_R$ for red light changes in response to the voltage of the data signal $Sd_R$ for red light. The voltage of the screen signal $Ss_G$ applied to the screen electrode $S_G$ for green light changes in response to the voltage of the data signal $Sd_G$ for green light. Likewise, the voltage of the screen signal $Ss_B$ applied to the screen electrode $S_B$ for blue light changes in response to the voltage of the data signal $Sd_B$ for blue light. Accordingly, since the voltage applied to the screen electrodes $S_R$, $S_G$, and $S_B$ increases only when the electron beams are emitted from the respective cathodes $K_R$, $K_G$, and $K_B$ in response to the respective data signals $Sd_R$, $Sd_G$, and $Sd_B$, electron beams having high density current can be emitted.

The static focus voltage Vfs applied to the first focus electrode F1 is higher than the maximum voltage of the screen signals $Ss_R$, $Ss_G$, and $Ss_B$ applied to the respective screen electrodes $S_R$, $S_G$, and $S_B$. The shapes of the outlets of the respective screen electrodes $S_R$, $S_G$, and $S_B$ and the inlets of the first focus electrode F1 are all circular. However, the outlets of the respective screen electrodes $S_R$, $S_G$, and $S_B$ are smaller than the inlets of the first focus electrode F1. Thus, a focus lens is formed between each of the screen electrodes $S_R$, $S_G$, and $S_B$ and the first focus electrode F1. The shapes of the inlets of the first focus electrode F1 to which the static focus voltage Vfs is applied, the inlets and outlets of the second focus electrode F2 to which the screen voltage Vec is applied, and the inlets of the third focus electrode F3 to which the static focus voltage Vfs is applied are all circular. Therefore, a focus lens SL is formed as a pre-focus lens (SL of FIG. 5A or 5B) among the first, second, and third focus electrodes F1, F2, and F3. The electron beams emitted from the third focus electrode F3 are focused by the focus lens $S_L$.

The shapes of the outlets of the third focus electrode F3 are horizontally elongated while the shapes of the inlets of the fourth focus electrode F4 are vertically elongated. The shapes of the outlets of the fifth focus electrode F5 are vertically elongated while the shapes of the inlets of the sixth focus electrode F6 are circular. The static focus voltage Vfs is applied to the third and fifth focus electrodes F3 and F5 while the dynamic focus voltage Vfd is applied to the fourth and sixth focus electrodes F4 and F6. The anode voltage Veb is applied to the final acceleration electrode A.

The driving of the double dynamic focus CRT is now described.

In the periods 0–t1 and t3–t4 in which the static focus voltage Vfs is lower than the dynamic focus voltage Vfd, a first dynamic quadrupole lens acting as a focusing lens ($Q_{L1V}$ of FIG. 5B) in a vertical direction and diverging lens ($Q_{L1H}$ of FIG. 5B) in a horizontal direction is formed between the third and fourth focus electrodes F3 and F4. A second dynamic quadrupole lens acting as a diverging lens ($Q_{L2V}$ of FIG. 5B) in a vertical direction and a focusing lens ($Q_{L2H}$ of FIG. 5B) in a horizontal direction is formed between the fifth and sixth focus electrodes F5 and F6. After passing through the second dynamic quadrupole lens, the electron beams pass through the main lens $M_L$ between the sixth focus electrode F6 and the final acceleration electrode A. Thus, electron beams having oval shapes corresponding to the vertical and horizontal deflecting voltages are output from the main lens $M_L$.

In the period t1–t3 in which the static focus voltage Vfs is higher than the dynamic focus voltage Vfd, a first dynamic quadrupole lens acting as a diverging lens ($Q_{L1V}$ of FIG. 5A) in a vertical direction and a focusing lens ($Q_{L1H}$ of FIG. 5A) in a horizontal direction is formed between the third and fourth focus electrodes F3 and F4. Also, a second dynamic quadrupole lens acting as a focusing lens ($Q_{L2V}$ of FIG. 5A) in a vertical direction and a diverging lens ($Q_{L2H}$ of FIG. 5A) in a horizontal direction is formed between the fifth and sixth focus electrodes F5 and F6. After passing through the second dynamic quadrupole lens, the electron beams pass through the main lens $M_L$ between the sixth focus electrode F6 and the final acceleration electrode A. Thus, electron beams have oval shapes, in cross-section, corresponding to the vertical and horizontal deflecting voltages are output from the main lens $M_L$.

Figure 9:
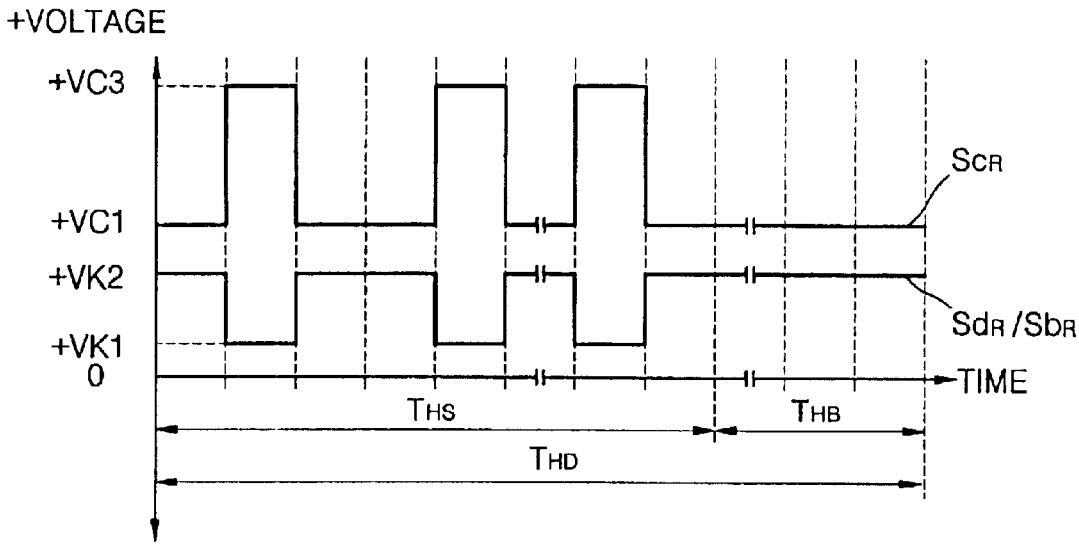
FIG. 9 is a timing diagram showing the data signal for red light applied to the cathode producing an electron beam producing red light and the control signal applied to the control electrode for controlling red light, for the CRT and electron gun shown in FIGS. 7 through 8B.

FIG. 9 shows the data signal $S_{dR}$ for red light applied to the cathode $K_R$ for producing red light and the control signal $Sc_R$ applied to the control electrode $C_R$ for red light, which are shown in FIGS. 7 through 8B. Referring to FIG. 9, in the conventional CRT, a constant voltage +VC1 is applied to the control electrode $C_R$ during a scanning period $T_{HS}$ and a blanking period $T_{HB}$ of a horizontal driving period $T_{HD}$. However, in the CRT according to the present invention, during the scanning period $T_{HS}$ of the horizontal driving period $T_{HD}$, the voltage of the control signal $Sc_R$ increases to +VC3 when the voltage of the data signal $Sd_R$ is lowered to +VK1 for the emission of the electron beams. When the voltage of the data signal $Sd_R$ increases to +VK2, to reduce the emission of the electron beams, the voltage of the control signal $Sc_R$ decreases to +VC1. Thus, the density of the cathode current can be efficiently increased without increasing the range of the change in the voltage of the data signal $Sd_R$ applied to the cathode $K_R$ for producing red light. During the blanking period $T_{HB}$ of the horizontal driving period $T_{HD}$, the constant voltage +VC1 is applied to the control electrode $C_R$ as in the conventional CRT.

Figure 10:
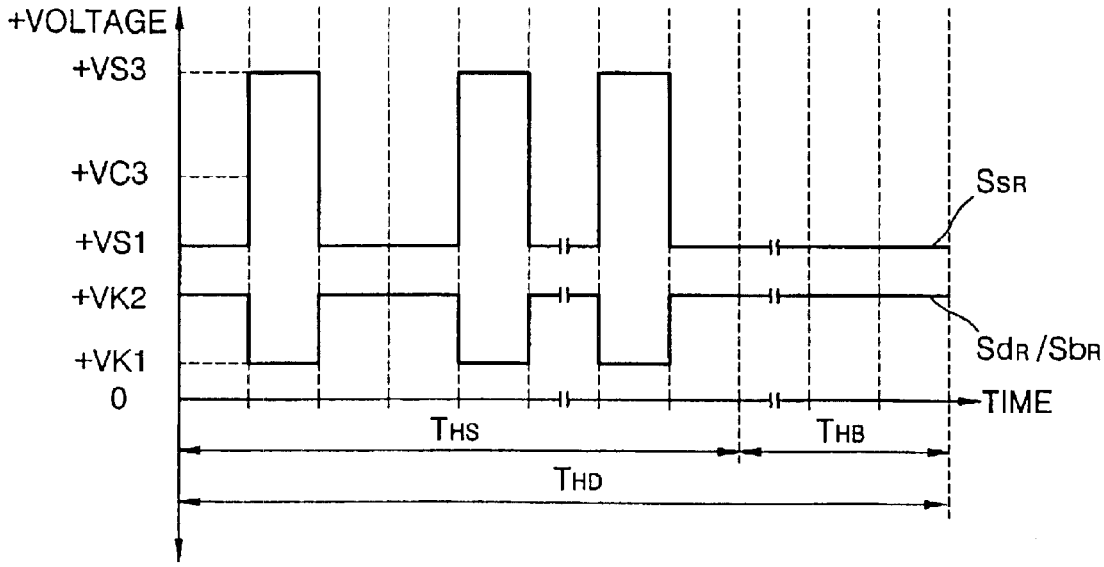
FIG. 10 is a timing diagram showing the data signal for red light applied to the cathode for producing an electron beam producing red light and the driving signal applied to the screen electrode for red light, for the CRT and electron gun shown in FIGS. 7 through 8B.

FIG. 10 shows the data signal $Sd_R$ for red light applied to the cathode $K_R$ for producing red light and the driving signal $Ss_R$ applied to the screen electrode $S_R$ for red light which are shown in FIGS. 7 through 8B. In FIG. 10, the same reference numerals as those of FIG. 9 indicate the same elements having the same functions. Referring to FIG. 10, in the conventional CRT, a constant voltage +VS1 is applied to the screen electrode $S_R$ during the scanning period $T_{HS}$ and the blanking period $T_{HB}$ of the horizontal driving period $T_{HD}$. However, in the CRT according to the present invention, during the scanning period $T_{HS}$ of the horizontal driving period $T_{HD}$, the voltage of the screen signal $Ss_R$ increases to +VS3 when the voltage of the data signal $Sd_R$ is lowered to +VK1 for the emission of the electron beams. When the voltage of the data signal $S_{dR}$ increases to +VK2, to reduce the emission of the electron beams, the voltage of the screen signal $Ss_R$ decreases to +VS1. Thus, the density of the cathode current can be efficiently increased without increasing the range of the change in the voltage of the data signal $Sd_R$ applied to the cathode electrode $K_R$. During the blanking period $T_{HB}$ of the horizontal driving period $T_{HD}$, the constant voltage +VS1 is applied to the screen electrode $S_R$.

Figure 11:
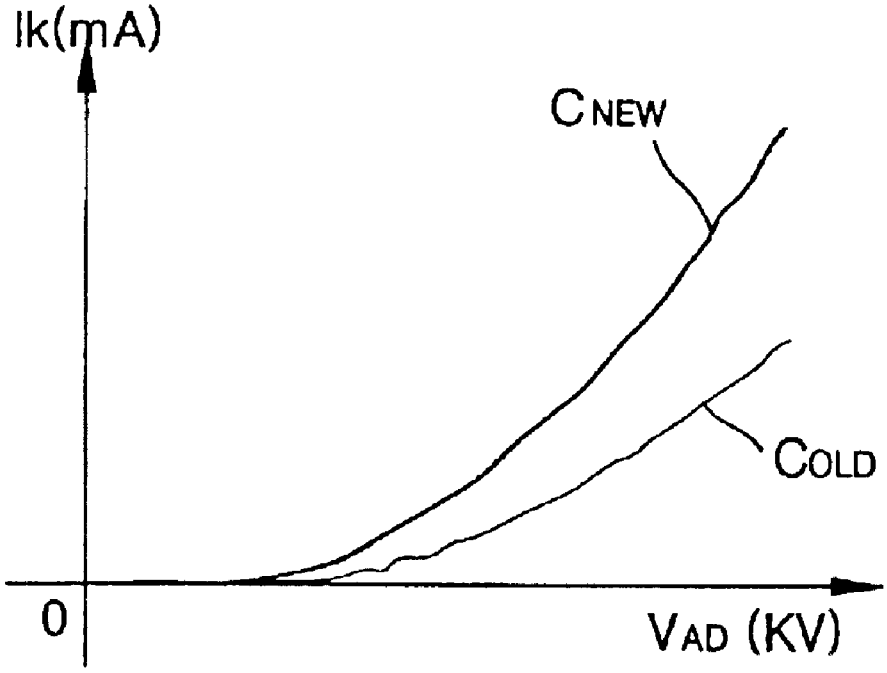
FIG. 11 is a graph showing measured cathode current with respect to the voltage of the data signal.

FIG. 11 shows the measured characteristic cathode current $I_R$ with respect to the voltage $V_{AD}$ of a data signal. In FIG. 11, reference character $C_{OLD}$ denotes a characteristic curve of a conventional CRT and reference character $C_{NEW}$ denotes a characteristic curve of a CRT according to a preferred embodiment of the present invention. Referring to FIG. 11, it can be seen that the cathode current $I_K$ increases without increasing the range of the change in the voltage $V_{AD}$ of a data signal applied to the electron gun in the CRT according to the present invention.

The described operation of the CRT according to the present invention may be performed only when the electron beams are scanned onto the periphery portion of the screen. That is, the horizontal scanning period ($T_{HS}$ of FIGS. 4, 9, and 10) may be divided into early, middle, and late scanning periods and the present driving method can be performed only during the early and late scanning periods (0–t1 and t3–t4 of FIG. 4). Accordingly, display performance at the peripheral portion of the screen can be much improved.

As described above, in the CRT according to the present invention, since the voltage applied to at least one of the control electrode and the screen electrode increases only when the electron beams are emitted from the corresponding cathode in response to the respective data signals, electron beams having high current density can be emitted. Thus, the density of the cathode current can be efficiently increased without increasing the range of the change, i.e., amplitude, of the voltage of the data signal applied to the cathode.

While this invention has been particularly shown and described with reference to preferred embodiments, it will be understood by those skilled in the art that various changes in form and details may be made therein without departing from the spirit and scope of the invention as defined by the appended claims.

What is claimed is:

1. A cathode ray tube (CRT) having an electron gun including a cathode for emitting electron beams, a control electrode for controlling emission of the electron beams from the cathode, and a screen electrode for accelerating the electron beams passing through the control electrode, arranged in series, wherein, the cathode includes a cathode for emitting an electron beam for producing red light, a cathode for emitting an electron beam for producing green light, and a cathode for emitting an electron beam for producing blue light, and the control electrode is divided into a control electrode for controlling the electron beam for producing red light, a control electrode for controlling the electron beam for producing green light, and a control electrode for controlling the electron beam for producing blue light, the control electrodes for controlling the electron beams for producing red light, green light, and blue light being mutually electrically insulated from each other.

2. The CRT as claimed in claim 1 wherein the control electrode for controlling the electron beam producing red light includes a first beam passing aperture for passing both of the electron beams for producing green light and blue light, and a second beam passing aperture for passing the electron beam from the cathode for producing red light, and the first beam passing aperture is larger than the second beam passing aperture, the control electrode for controlling the electron beam producing green light includes a first beam passing aperture for passing both of the electron beams for producing red light and blue light, and a second beam passing aperture for passing the electron beam for producing green light, and the first beam passing aperture is larger than the second beam passing aperture, and the control electrode for controlling the electron beam producing blue light includes a first beam passing aperture for passing both of the electron beams for producing red light and green light, and a second beam passing aperture for passing the beam electron for producing blue light, and the first beam passing aperture is larger than the second beam passing aperture.

3. A cathode ray tube (CRT) having an electron gun including a cathode for emitting electron beams, control electrode for controlling emission of the electron beams from the cathode, and a screen electrode for accelerating the electron beams passing through the screen electrode, arranged in series, wherein, the cathode includes a cathode for emitting an electron beam for producing red light, a cathode for emitting an electron beam for producing green light, and a cathode for emitting an electron beam for producing blue light, and the screen electrode is divided into a screen electrode for accelerating the electron beam for producing red light, a screen electrode for accelerating the electron beam for producing green light, and a screen electrode for accelerating the electron beam for producing blue light, the screen electrodes for accelerating the electron beams for producing red light, green light, and blue light being mutually electrically insulated from each other.

4. The CRT as claimed in claim 3 wherein the screen electrode for accelerating the electron beam producing red light includes a first beam passing aperture for passing both of the electron beams for producing green light and blue light and a second beam passing aperture for passing the electron beam for producing red light, and the first beam passing aperture is larger than the second beam passing aperture, the screen electrode for accelerating the electron beam producing green light includes a first beam passing aperture for passing both of the electron beams for producing red light and blue light and a second beam passing aperture for passing the electron beam for producing green light, and the first beam passing aperture is larger than the second beam passing aperture, and the screen electrode for accelerating the electron beam, producing blue light includes a first beam passing aperture for passing both of the electron beams for producing red light and green light and a second beam passing aperture for passing the electron beam for producing blue light, and the first beam passing aperture is larger than the second beam passing aperture.

5. The CRT as claimed in claim 3 wherein the control electrode is divided into a control electrode for controlling the electron beam for producing red light, a control electrode for controlling the electron beam for producing green light, and a control electrode for controlling the electron beam for producing blue light, the control electrodes for controlling the electron beams for producing red light, green light, and blue light being mutually electrically insulated from each other.

6. The CRT as claimed in claim 5 wherein the control electrode for controlling the electron beam producing red light includes a first beam passing aperture for passing both of the electron beams for producing green light and blue light, and a second beam passing aperture for passing the electron beam from the cathode for producing red light, and the first beam passing aperture is larger than the second beam, passing aperture, the control electrode for controlling the electron beam producing green light includes a first beam passing aperture for passing both of the electron beams for producing red light and blue light, and a second beam passing aperture for passing the electron beam for producing green light, and the first beam passing aperture is larger than the second beam passing aperture, and the control electrode for controlling the electron beam producing blue light includes a first beam passing aperture for passing both of the electron beams for producing red light and green light, and a second beam passing aperture for passing the electron beam for producing blue light, and the first beam passing aperture is larger than the second beam passing aperture.

7. A cathode ray tube (CRT) having an electron gun including, arranged in series, a cathode for emitting an electron beam, in response to a data signal applied to the cathode, a control electrode for controlling passage of the electron beam emitted from the cathode, and a screen electrode for accelerating the electron beam passing through the control electrode, wherein, during a horizontal scanning period, a voltage applied to at least one of the control electrode and the screen electrode increases in response to a decrease in voltage of the data signal applied to the cathode, whereby current density of the electron beam is increased without increasing magnitude of changes in the voltage of the data signal.

8. The CRT as claimed in claim 7, wherein the horizontal scanning period is divided into early, middle, and late scanning periods, and a voltage applied to at least one of the control electrode and the screen electrode changes in response to a voltage of a data signal applied to the cathode only during the early and late scanning periods.

9. The CRT as claimed in claim 7, wherein the cathode includes a cathode for emitting an electron beam for producing red light, a cathode for emitting an electron beam for producing green light, and a cathode for emitting an electron beam for producing blue light, and the control electrode is divided into a control electrode for controlling the electron beam for producing red light, a control electrode for controlling the electron beam for producing green light, and a control electrode for controlling the electron beam for producing blue light, the control electrodes for controlling the electron beams for producing red light, green light, and blue light being mutually electrically insulated from each other.

10. The CRT as claimed in claim 9, wherein a voltage applied to the control electrode for controlling the electron beam for producing red light during the horizontal scanning period changes in response to voltage of a data signal applied to the cathode for producing the electron beam producing red light, a voltage applied to the control electrode for controlling the electron beam for producing green light during the horizontal scanning period changes in response to voltage of a data signal applied to the cathode for producing the electron beam producing green light, and a voltage applied to the control electrode for controlling the electron beam for producing blue light during the horizontal scanning period changes in response to voltage of a data signal applied to the cathode for producing the electron beam producing blue light.

11. The CRT as claimed in claim 9 wherein the control electrode for controlling the electron beam for producing red light includes a first beam passing aperture for passing both of the electron beams for producing green light and blue light and a second beam passing aperture for passing the electron beam for producing red light, and the first beam passing aperture is larger than the second beam passing aperture, the control electrode for controlling the electron beam for producing green light includes a first beam passing aperture for passing both of the electron beams for producing red light and blue light and a second beam passing aperture for passing the electron beam for producing green light, and the first beam passing aperture is larger than the second beam passing aperture, and the control electrode for controlling the electron beam for producing blue light includes a first beam passing aperture for passing both of the electron beams for producing red light and green light and a second beam passing aperture for passing the electron beam for producing blue light, and the first beam passing aperture is larger than the second beam passing aperture.

12. The CRT as claimed in claim 7, wherein the cathode includes a cathode for emitting an electron beam for producing red light, a cathode for emitting an electron beam for producing green light, and a cathode for emitting an electron beam for producing blue light, and the screen electrode is divided into a screen electrode for accelerating the electron beam producing red light, a screen electrode for accelerating the electron beam producing green light, and a screen electrode for accelerating the electron beam producing blue light, the screen electrodes for accelerating the electron beams producing red light, green light, and blue light being mutually electrically insulated from each other.

13. The CRT as claimed in claim 12, wherein a voltage applied to the screen electrode for accelerating the electron beam producing red light during the horizontal scanning period changes in response to voltage of a data signal applied to the cathode for producing the electron beam producing red light, a voltage applied to the screen electrode for accelerating the electron beam producing green light during the horizontal scanning period changes in response to voltage of a data signal applied to the cathode for producing the electron beam for producing green light, and a voltage applied to the screen electrode for accelerating the electron beam producing blue light during the horizontal scanning period changes in response to voltage of a data signal applied to the cathode for producing the electron beam for producing blue light.

14. The CRT as claimed in claim 12 wherein the screen electrode for accelerating the electron beam producing red light includes a first beam passing aperture for passing both of the electron beams for producing green light and blue light and a second beam passing aperture for passing the electron beam for producing red light, and the first beam passing aperture is larger than the second beam passing aperture, the screen electrode for accelerating the electron beam producing green light includes a first beam passing aperture for passing both of the electron beams for producing red light and blue light and a second beam passing aperture for passing the electron beam for producing green light, and the first beam passing aperture is larger than the second beam passing aperture, and the screen electrode for accelerating the electron beam producing blue light includes a first beam passing aperture for passing both of the electron beams for producing red light and green light and a second beam passing aperture for passing the electron beam for producing blue light, and the first beam passing aperture is larger than the second beam passing aperture.

* * * * *